US008146688B2

(12) United States Patent
Marvel et al.

(10) Patent No.: US 8,146,688 B2
(45) Date of Patent: Apr. 3, 2012

(54) DRILL BIT WITH PREFABRICATED CUTTINGS SPLITTER AND METHOD OF MAKING

(75) Inventors: Timothy K. Marvel, The Woodlands, TX (US); Michael R. Wells, Lakewood, CO (US)

(73) Assignee: Baker Hughes Incorporated, Houston, TX (US)

( * ) Notice: Subject to any disclaimer, the term of this patent is extended or adjusted under 35 U.S.C. 154(b) by 176 days.

(21) Appl. No.: 12/427,980

(22) Filed: Apr. 22, 2009

(65) Prior Publication Data

US 2010/0270087 A1 Oct. 28, 2010

(51) Int. Cl.
*E21B 10/46* (2006.01)
*E21B 10/58* (2006.01)
*E21B 10/62* (2006.01)

(52) U.S. Cl. ..... 175/430; 175/378; 175/426; 175/434

(58) Field of Classification Search ..... 175/430, 175/426, 434, 378
See application file for complete search history.

(56) References Cited

U.S. PATENT DOCUMENTS

| | | | | |
|---|---|---|---|---|
| 4,351,401 | A | 9/1982 | Fielder | |
| 4,397,361 | A * | 8/1983 | Langford, Jr. | 175/428 |
| 4,727,946 | A | 3/1988 | Barr et al. | |
| 5,172,778 | A | 12/1992 | Tibbitts et al. | |
| 5,199,511 | A | 4/1993 | Tibbitts et al. | |
| 5,582,258 | A | 12/1996 | Tibbitts et al. | |
| 5,651,420 | A | 7/1997 | Tibbitts et al. | |
| 5,794,725 | A | 8/1998 | Trujillo et al. | |
| 5,836,404 | A | 11/1998 | Trujillo et al. | |
| 5,901,797 | A | 5/1999 | Hansen et al. | |
| 5,957,227 | A | 9/1999 | Besson et al. | |
| 5,992,549 | A | 11/1999 | Fuller | |
| 6,073,518 | A | 6/2000 | Chow et al. | |
| 6,164,394 | A | 12/2000 | Mensa-Wilmot et al. | |
| 6,328,117 | B1 | 12/2001 | Berzas et al. | |
| 6,338,390 | B1 | 1/2002 | Tibbitts | |
| 6,460,631 | B2 | 10/2002 | Dykstra et al. | |
| 6,527,065 | B1 | 3/2003 | Tibbitts et al. | |
| 6,564,886 | B1 | 5/2003 | Mensa-Wilmot et al. | |
| 6,659,199 | B2 | 12/2003 | Swadi | |
| 7,237,628 | B2 * | 7/2007 | Desai et al. | 175/406 |
| 2010/0163310 | A1 * | 7/2010 | Vempati et al. | 175/57 |
| 2010/0224419 | A1 * | 9/2010 | Marvel et al. | 175/426 |
| 2010/0270087 | A1 * | 10/2010 | Marvel et al. | 175/426 |

OTHER PUBLICATIONS

"Into"—definition thereof, www.google.com and www.answers.com, 2011.*

Wells, M., et al. "Bit Balling Mitigation in PDC Bit Design," IADC/SPE Asia Pacific Drilling Technology Conference and Exhibition, Jakarta, Indonesia, Aug. 25-27, 2008, Paper No. 114673-MS.

(Continued)

*Primary Examiner* — Jennifer H Gay
(74) *Attorney, Agent, or Firm* — Cantor Colburn LLP

(57) ABSTRACT

A downhole drill bit includes, a body, a plurality of cutters attached to the body, and at least one prefabricated splitter having a proximal portion and at least one distal portion. The proximal portion is encased within the body and the at least one distal portion extends outwardly of the body. Further the at least one distal portion is in operable communication with at least one of the plurality of cutters such that the at least one distal portion bifurcates cuttings cut by the at least one cutter.

11 Claims, 5 Drawing Sheets

OTHER PUBLICATIONS

Van Oort, Eric, et al., "Drilling More Stable Wells Faster and Cheaper with PDC Bits and Water Based Muds," IADC/SPE Drilling Conference, New Orleans, Louisiana, Feb. 23-25, 2000, Paper No. 59192-MS.

Allen, S., et al. "Optimized Performance with New Eccentric Hole-Enlargement tool Through Improved Directional Control Bit Cleaning, and Dysfunction Mitigation in Soft, Balling, and Swelling Formations," SPE Western regional Meeting, San Jose, Mar. 24-26, 2009, Paper No. 121269-MS.

* cited by examiner

DRILL BIT WITH PREFABRICATED CUTTINGS SPLITTER AND METHOD OF MAKING

BACKGROUND

In the hydrocarbon drilling industry, rotary drill bits that drill into subterranean formations form cuttings that are carried away with drilling fluid that is pumped through the drill bit. Junk slots are provided in the drill bit to permit passage therethrough of the drilling fluid and the cuttings carried therewith. Cuttings, however, can be of a size that they become lodged in the junk slots thereby blocking the junk slots and detrimentally affecting a rate of penetration of the drilling operation. Systems and methods to lessen occurrences of these conditions are well received in the art.

BRIEF DESCRIPTION

Disclosed herein is a method of making a drill bit for drilling subterranean formations. The method includes, forming a bit mold having at least one recess receptive of a distal portion of a prefabricated splitter, positioning the distal portion into one of the at least one recess, and filling the bit mold with at least one material.

Further disclosed herein is a downhole drill bit. The bit includes, a body, a plurality of cutters attached to the body, and at least one prefabricated splitter having a proximal portion encased within the body and at least one distal portion extending outwardly of the body, the at least one distal portion is in operable communication with at least one of the plurality of cutters such that the at least one distal portion bifurcates cuttings cut by the at least one cutter.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
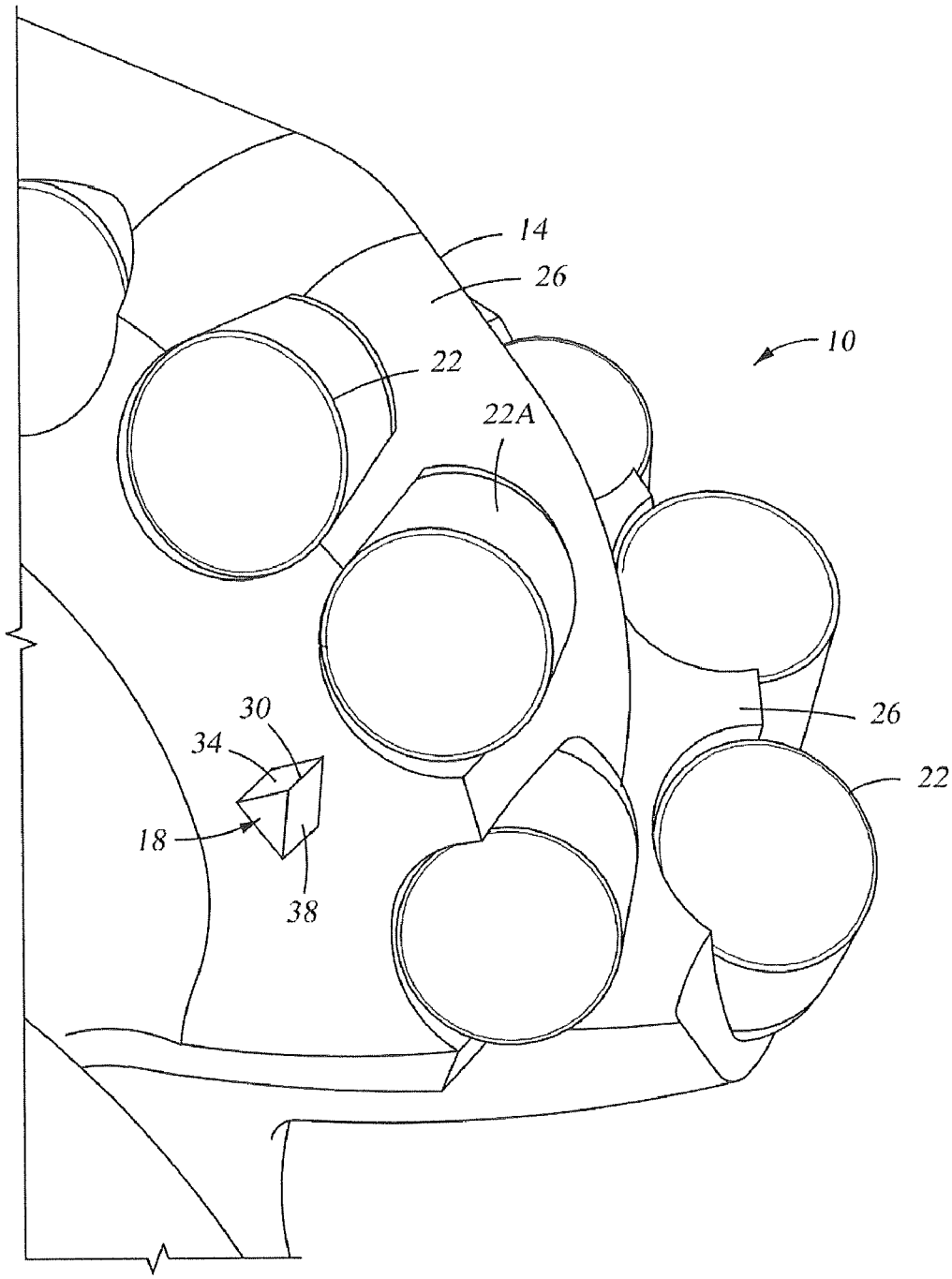
FIG. 1 depicts a partial perspective view of a downhole drill bit disclosed herein.

Referring to FIG. 1, an embodiment of a downhole drill bit 10 disclosed herein is illustrated. The drill bit 10 includes, a body 14 with a prefabricated cuttings splitter 18 and a plurality of cutters 22 attached thereto. The prefabricated splitter 18 is insert molded into the body 14 as will be described in detail with reference to FIGS. 3-5 below. The prefabricated splitter 18 is configured to bifurcate cuttings, or chips, that are cut from a formation by a cutter 22A. By bifurcating the cuttings into smaller pieces, junk slots positioned between perimetrically adjacent blades 26 of the body 14 are less likely to become blocked or plugged. The prefabricated splitter 18 has a splitter edge 30 defined by an intersection between surfaces 34 and 38. The surfaces 34 and 38 of this embodiment are polished, however, other embodiments may use unpolished surfaces or surfaces modified by inclusion of one or more of, dimples, polytetrafluoroethylene (PTFE) treating, chrome plating, hardfacing, physical vapor deposition (PVD)/chemical vapor deposition (CVD) coatings, diamond-like coatings and combinations thereof. Making the splitter edge 30 sharp can improve the operational efficiency of the splitter 18. The edge of the splitter 18 can be perpendicular to the cutter 22 as illustrated in this embodiment or slanted, for example, such that a distal portion of the splitter edge 30 is nearer the cutter 22 than a proximal point. Slanting the splitter edge 30 in this manner increases the likelihood that cuttings will be "trapped" by the splitter 18 increasing the likelihood that cuttings are bifurcated rather than just passing over the splitter 18.

Figure 2:
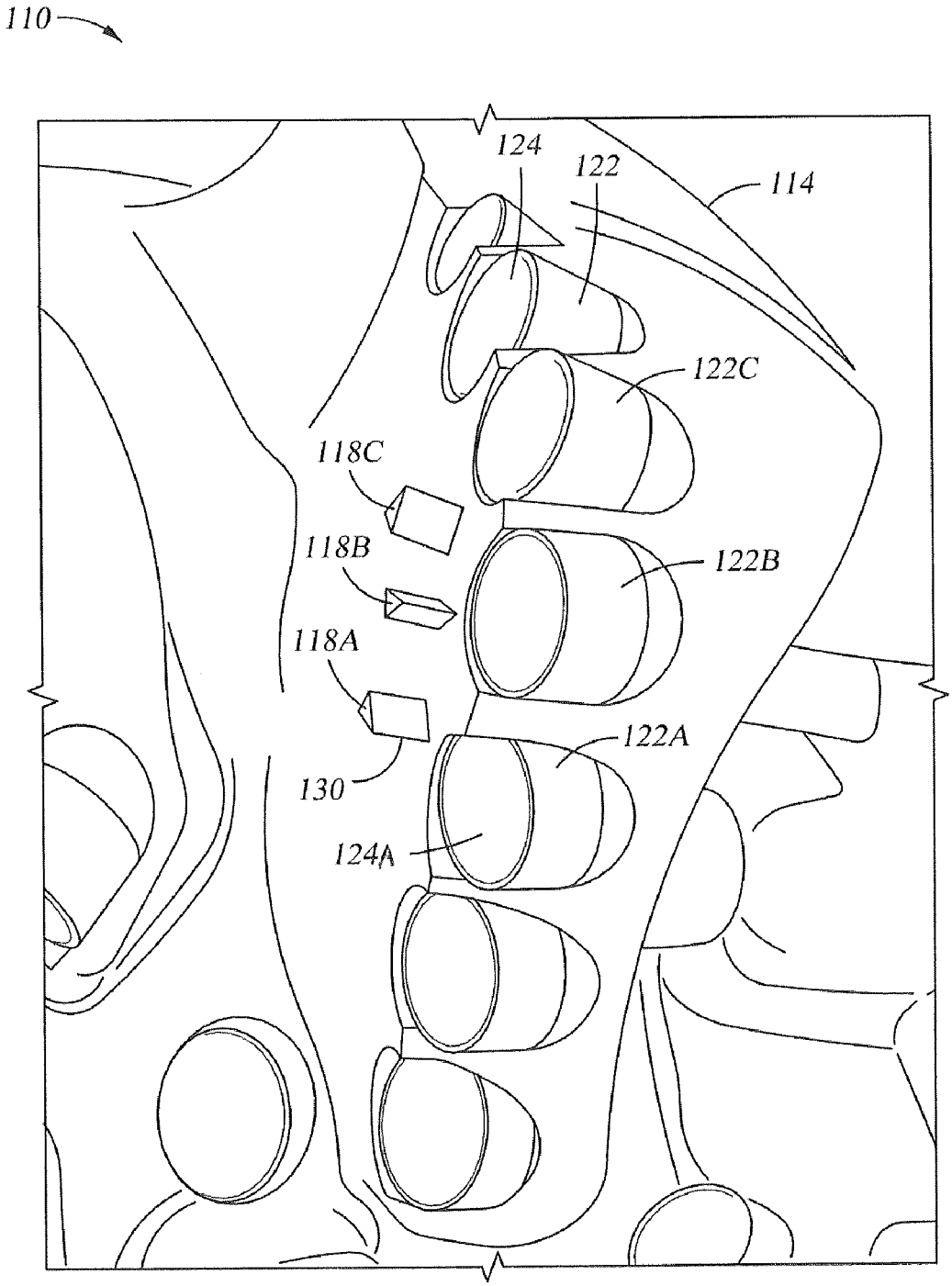
FIG. 2 depicts a partial perspective view of an alternate downhole drill bit disclosed herein.

Referring to FIG. 2, an alternate embodiment of a downhole drill bit 110 disclosed herein is illustrated. The drill bit 110 includes three prefabricated splitters 118A, 118B and 118C; however, alternate embodiments may have any number of prefabricated splitters 118 including one in operable communication with every one of cutters 122, for example. In this embodiment the prefabricated splitters 118A, 118B, 118C are in operable communication with the cutters 122A, 122B, 122C, respectively. Each of the prefabricated splitters 118 is positioned downstream from its respective cutter 122 with the downstream orientation being defined by a relative direction of travel of cuttings produced by each cutter 122. For example, cuttings produced by the cutter 122A travel across cutter face 124A and into the prefabricated splitter 118A. The prefabricated splitters 118 each have a splitter edge 130 positioned substantially central to the cuttings contacting therewith to bifurcate the cuttings substantially into two more or less equal portions. The relative positioning of the splitter edge 130 to the face 124 can vary depending upon specifics of each application.

Figure 3A:
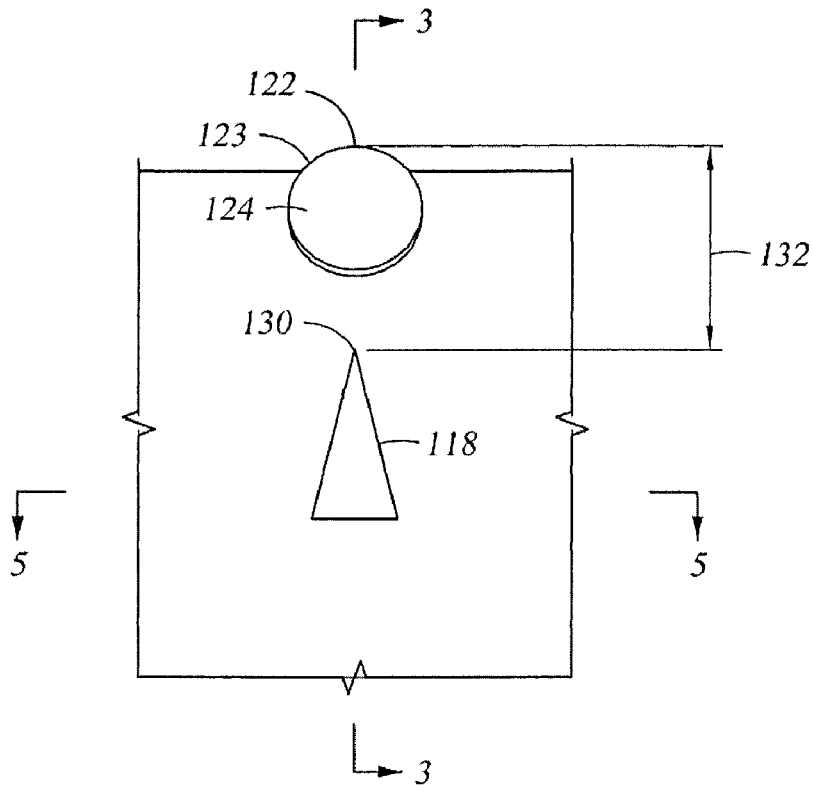
FIG. 3A depicts a partial front view of the downhole drill bit of FIG. 1.
Figure 3B:
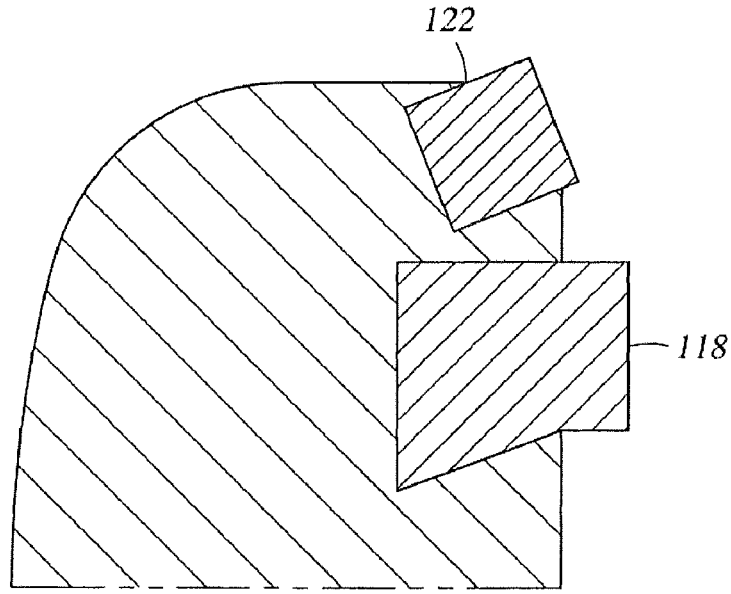
FIG. 3B depicts a partial side cross-sectional view of the downhole drill bit of FIG. 3A taken at arrows 3-3.

Referring to FIGS. 3A and 3B, partial front and side sectional views, respectively, are depicted showing a relative position of the prefabricated splitters 118 to the cutters 122. In this embodiment, the splitter edge 130 of each of the prefabricated splitters 118 are offset a dimension 132 from a leading edge 123 of the face 124 of the cutter 122.

Figure 4:
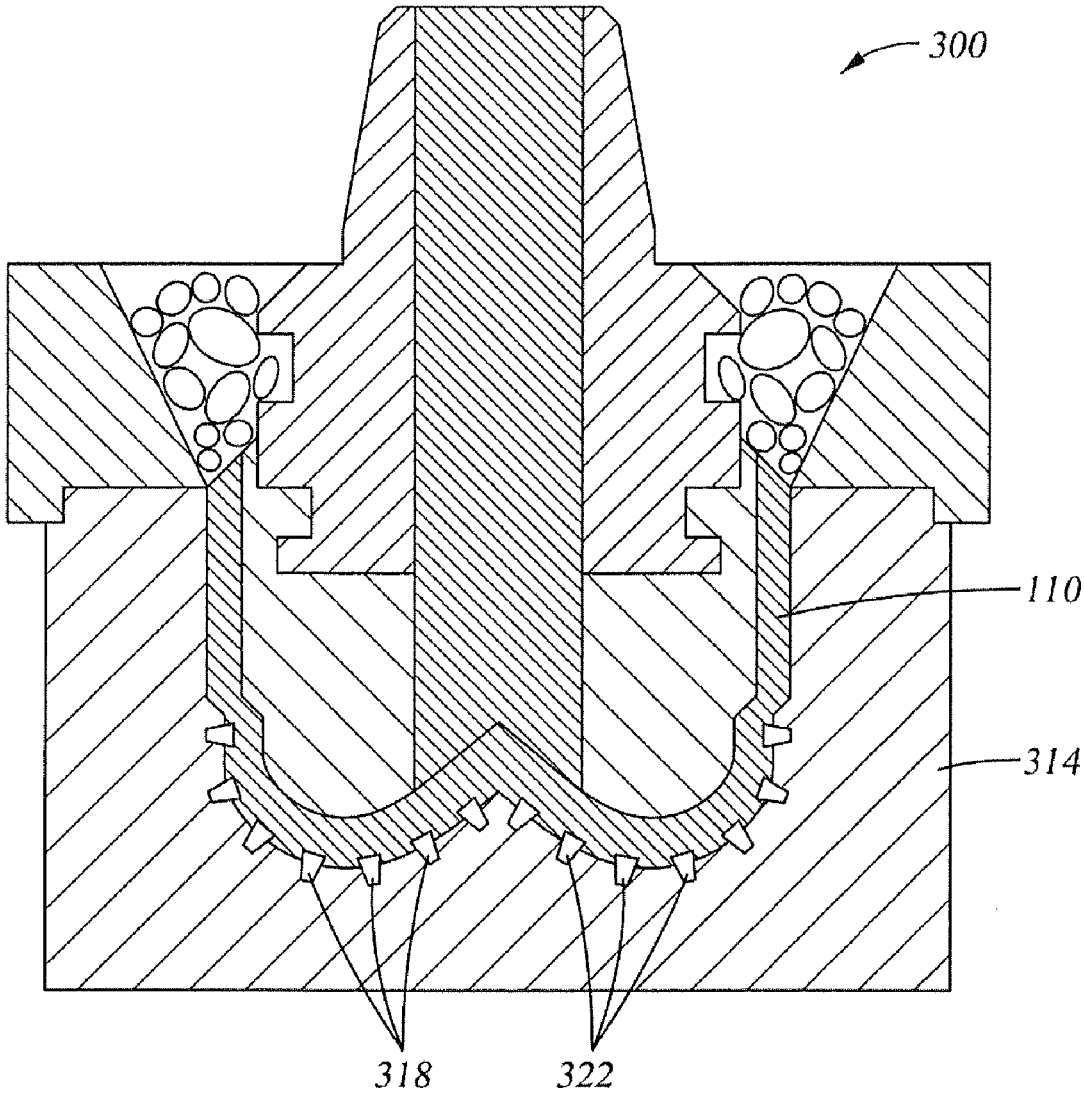
FIG. 4 depicts a cross-sectional view of a bit mold containing the drill bit of FIG. 2.

Referring to FIG. 4, a cross-sectional view is depicted of a bit mold 300 with the drill bit 110 disclosed herein positioned therewithin. Molding the body 114 of the drill bit 110 with the prefabricated splitters 118 pre-positioned within the bit mold 300 is one method disclosed herein of producing the drill bit 110. Doing so includes forming a cavity 314 of the bit mold 300 that includes a plurality of recesses 318 receptive of a distal portion 322 of the prefabricated splitters 118 themselves. The recesses 318 have sharp corners therein to mate with the splitter edge 130 of the prefabricated splitters 118. After the prefabricated splitters 118 are positioned in the recesses 318 of the bit mold 300, powdered materials such as, steel, tungsten carbide, tungsten carbide matrix, polycrystalline diamond, ceramics and combinations thereof, for example, are positioned within the bit mold 300 and heated to sinter the powdered material and form the drill bit 110. After which the bit mold 300 can be cooled, opened and the drill bit 110 removed.

Figure 5:
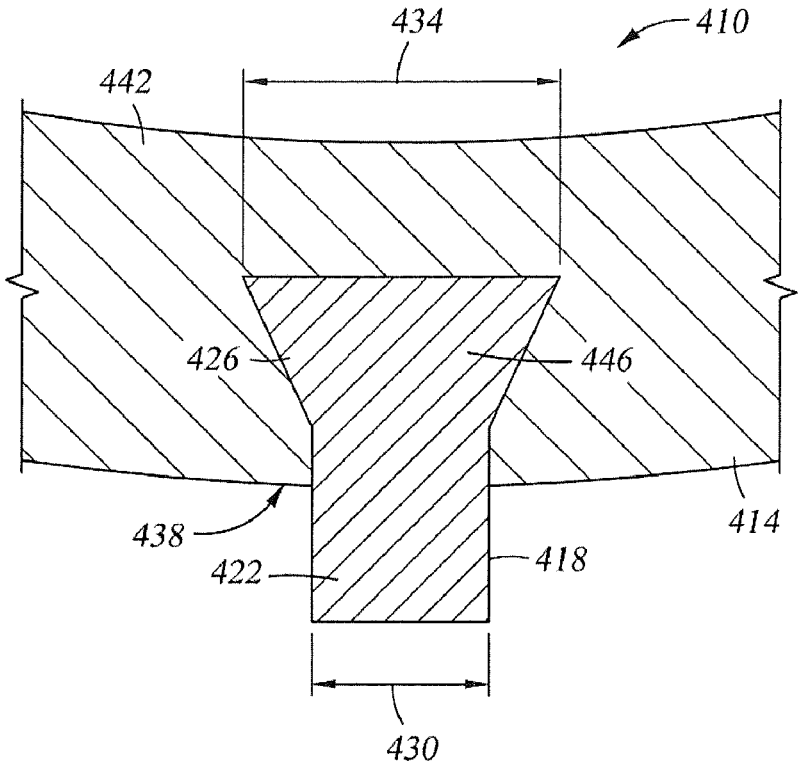
FIG. 5 depicts another cross-sectional view of the downhole drill bit of FIG. 3A taken at arrows 5-5.

Referring to FIG. 5, an alternate embodiment of a drill bit 410 disclosed herein is illustrated. The drill bit 410 includes a body 414 with a prefabricated splitter 418 fixedly attached to the body 414. The prefabricated splitter 418 has a distal portion 422 that extends away from the body 414 and a proximal portion 426 positioned within the body 414. The proximal portion 426 has a dimension 430 positioned deeper within the body that is larger than a dimension 434 of the proximal portion 426 that is positioned nearer to a surface 438 of the body 414 that mechanically locks the proximal portion within the body 414 even if there were no direct bonding between the splitter 418 and the body 414. Embodiments, may, however, be configured to have bonding occur between the proximal portion 426 and the body 414 to further enhance the structural connection therebetween. A cross sectional shape of the proximal portion 422 can be any shape, including noncircular shapes, such as, oval, square, rectangular and polygonal, for example, to prevent rotational motion between the prefabricated splitter 418 and the body 414.

The drill bit 410 can be formed in the bit mold 300 described above. A plurality of the prefabricated splitters 418 can be preformed with unique distal portions 422 as well as unique proximal portions 426. The distal portions 422 of each are then positioned within one of the recesses 318 prior to filling the bit mold 300 with a material 442. The material 442 may be hardenable after it has filled the bit mold 300 to form the body 414. Alternately the material 442 may be sinterable to form a solid upon heating of the material 442. Such heating can also cause a bonding between the material 442 and the proximal portion 426 of each of the prefabricated splitters 418. This process allows the drill bit 410 to have the prefabricated splitters 418 made of a different material 446 than the material 442 of the body 414. For example, an operator may prefer to have the body 414 made of a ductile material, such as copper, while having the prefabricated splitters 418 made of a stronger and less ductile material such as polycrystalline diamond compact (PDC), thermally stable polycrystalline diamond (TSP), cubic boron nitride (CBN), polycrystalline cubic boron nitride (PCBN), carbon, ceramics and combinations of the aforementioned.

Figure 6:
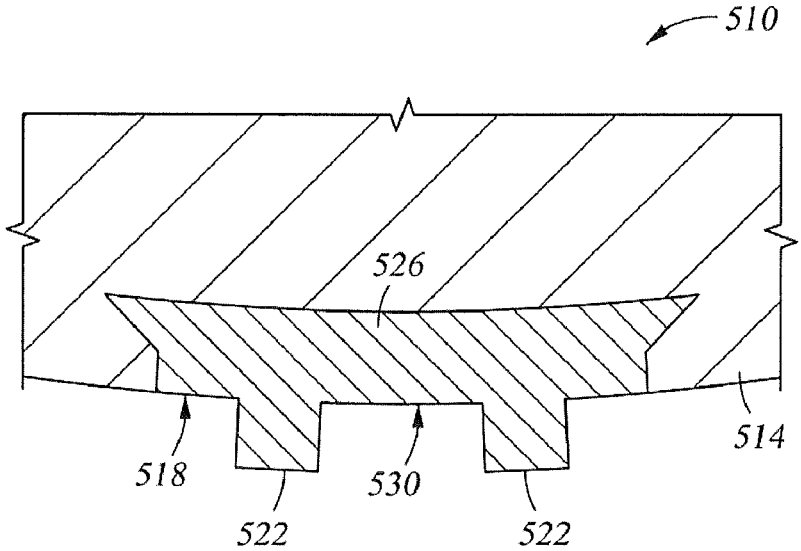
FIG. 6 depicts a partial cross-sectional view of an alternate embodiment of a downhole drill.

Referring to FIG. 6, an alternate embodiment of a drill bit 510 having prefabricated splitters 518 with a plurality of distal portions 522 attached to a single proximal portion 526 insert-molded into a body 514 is illustrated. It may be desirable to have more than one distal portion 522 attached to a single proximal portion 526 to increase strength of the prefabricated splitter 518 or the body 514, for example, in comparison to each distal portion 522 having a separate proximal portion 526. Additionally, a surface 530 of the proximal portion 526 may abut a surface (not shown) of the bit mold 300, thereby forming a portion of a surface of the drill bit 510, such as, a surface between adjacent distal portions 522, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole drill bit comprising:

a body;

a plurality of cutters attached to the body; and at least one prefabricated splitter having a proximal portion encased within the body and at least one distal portion extending outwardly of the body, the proximal portion having a larger dimension positioned deeper within the body than a dimension nearer to a surface of the body to mechanically lock the at least one prefabricated splitter into the body, the at least one distal portion being in operable communication with at least one of the plurality of cutters such that the at least one distal portion bifurcates cuttings cut by the at least one cutter.

2. The downhole drill bit of claim 1, wherein the proximal portion has a noncircular cross-sectional shape.

3. The downhole drill bit of claim 1, wherein the proximal portion is bonded to the body.

4. The downhole drill bit of claim 1, wherein a material of the at least one prefabricated splitter is different than a material of the body.

5. The downhole drill bit of claim 1, wherein the at least one prefabricated splitter is made of a material selected from the group consisting of polycrystalline diamond compact (PDC), thermally stable polycrystalline diamond (TSP), cubic boron nitride (CBN), polycrystalline cubic boron nitride (PCBN), carbon, ceramics and combinations of the aforementioned.

6. The downhole drill bit of claim 1, wherein the at least one prefabricated splitter includes a splitter edge configured to be a first portion of the at least one prefabricated splitter to engage cuttings.

7. The downhole drill bit of claim 6, wherein the splitter edge is oriented substantially perpendicular to a face of the at least one of the plurality of cutters with which the at least one splitter having the splitter edge is in operable communication.

8. The downhole drill bit of claim 6, wherein the splitter edge is slanted such that a distal portion of the splitter edge is nearer the cutter than a proximal portion of the splitter edge.

9. The downhole drill bit of claim 6, wherein the splitter edge is downstream of a cutter edge on a face of the at least one of the plurality of cutters that the at least one splitter having the splitter edge is in operable communication with, downstream being defined by a flow of the cuttings relative to the cutter edge.

10. The downhole drill bit of claim 6, wherein at least two surfaces of the at least one splitter intersect at the splitter edge.

11. The downhole drill bit of claim 10, wherein at least one of the at least two surfaces includes one from the group consisting of polytetrafluoroethylene (PTFE) treating, chrome plating, hardfacing, physical vapor deposition/chemical vapor deposition coatings, diamond-like coatings and combinations of two or more of the foregoing.

* * * * *